United States Patent [19]

Glatz et al.

[11] Patent Number: 4,586,525

[45] Date of Patent: May 6, 1986

[54] LARGE UMBRELLA

[75] Inventors: Adolf Glatz; Peter Glatz, both of Frauenfeld, Switzerland

[73] Assignee: Glatz AG, Frauenfeld, Switzerland

[21] Appl. No.: 648,273

[22] Filed: Sep. 6, 1984

[30] Foreign Application Priority Data

Sep. 8, 1983 [CH] Switzerland ..... 4897/83

[51] Int. Cl.[4] ..... A45B 11/00

[52] U.S. Cl. ..... 135/20 A; 135/20 M; 135/21

[58] Field of Search ..... 135/20 A, 20 M, 21, 135/27, 98; 248/122, 125

[56] References Cited

U.S. PATENT DOCUMENTS

| | | | |
|---|---|---|---|
| 321,612 | 7/1885 | Kuhn | 135/21 |
| 544,632 | 8/1895 | Sweeting | 135/21 |
| 565,619 | 8/1896 | Haynes | 135/21 |
| 1,042,658 | 10/1912 | Dunnenberger et al. | 135/20 A |
| 1,781,372 | 11/1930 | Denecke | 248/122 |
| 2,605,778 | 8/1952 | Clapper | 248/122 |
| 2,671,459 | 3/1954 | Henderson | 135/20 A |
| 2,782,795 | 2/1957 | Small | 135/20 M |
| 2,905,187 | 9/1959 | Croce | 135/20 A |
| 3,514,062 | 5/1970 | Gordon | 248/125 |
| 3,765,434 | 10/1973 | Riggs | 135/20 A |

FOREIGN PATENT DOCUMENTS

| | | | |
|---|---|---|---|
| 3229776 | 4/1983 | Fed. Rep. of Germany | 135/21 |
| 82/03538 | 10/1982 | World Int. Prop. O. | 135/20 A |

*Primary Examiner*—Robert A. Hafer
*Assistant Examiner*—Daniel Nolan
*Attorney, Agent, or Firm*—McCormick, Paulding & Huber

[57] ABSTRACT

A large umbrella arrangement includes a stand (2) having a mast (10) to which an extendable and retractable support arm (4) is connected. A connecting member (12) is pivotally connected to the middle area of the support arm (4) and at its other end is pivotally connected to the upper end of the mast (10). One end (26) of the support arm (4) engages the mast (10) by means of a roll (32). This end (26) is further provided with a fork (28) whose arms (30) overlap and receive the mast (10). The support arm (4) is fixable by means of the fork (28) at different height positions on the mast (10), with such fixing in different heights involving the use of an arresting bolt (36) insertable in a bore (34) in the mast (10). At the free end of the support arm (4) is a pin (20) protruding from the support arm from which the umbrella (8) is hung through a hanging means (6).

9 Claims, 8 Drawing Figures

Figures 1, 2, 3:
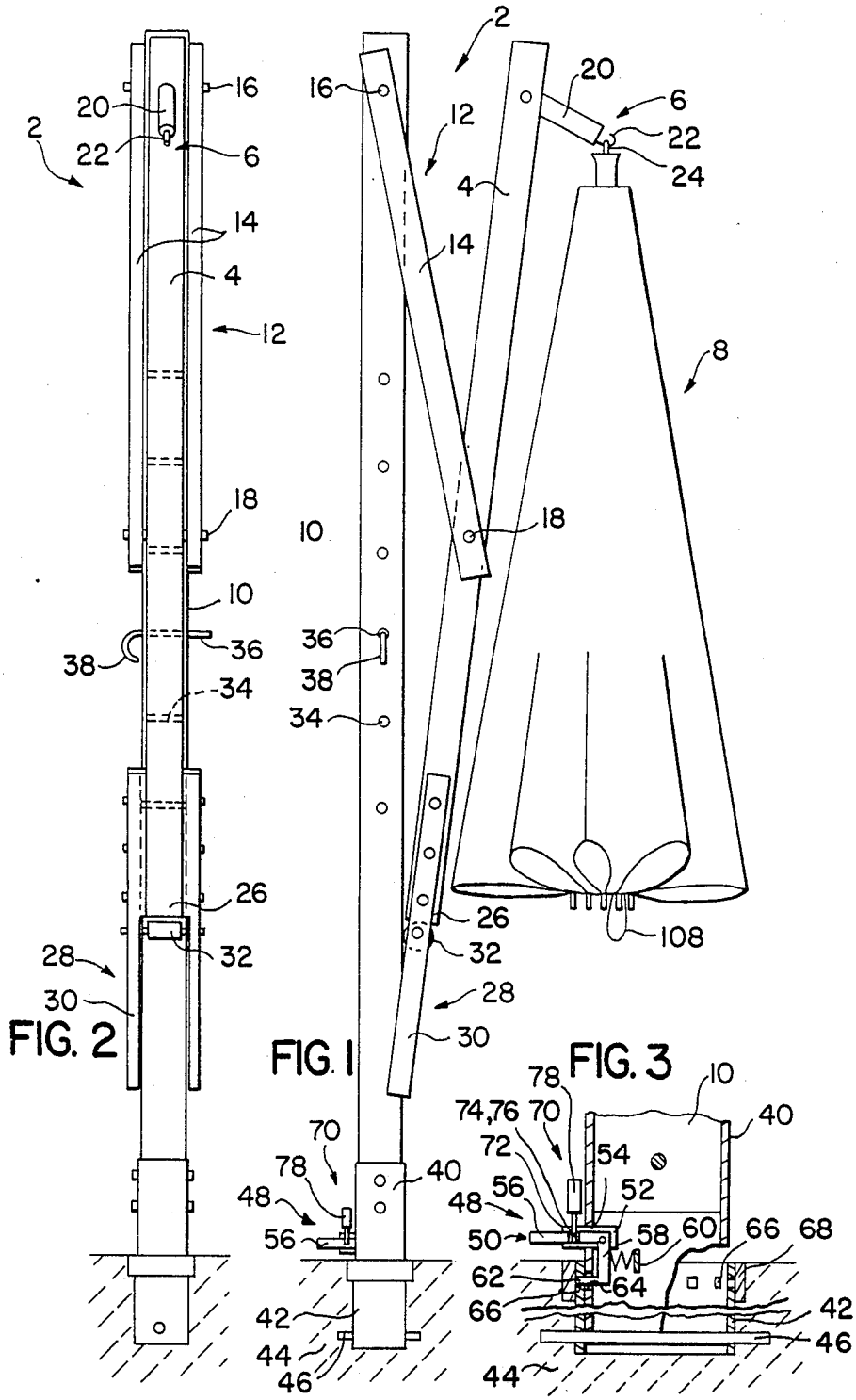

2
20
22
6
16
14
4
12
18
10
36
38
34
26
32
28
30

8
24
108
70
78
40
48
56
42
44
46
74,76
72
54
52
50
58
60
66
68
62
64

LARGE UMBRELLA

The invention relates to a large umbrella arrangment, such as suited for use in gardens, market stands, and outdoor seats for restaurants and the like.

Large umbrella arrangments of the foregoing type are already known in different forms. For example WO82/03538 describes a large number of different types of such arrangments. All large umbrellas are however of relatively complicated construction and cannot exceed a certain size and height. This is because such umbrellas in general are so conceived that extension of the support arm is combined with the opening of the umbrella, so that a relatively high force is required for extending and opening the umbrella. The combination of the extending and opening mechanism also means that such umbrella is not removable from the support arm and in the opened condition cannot be changed in inclination. An umbrella of the foregoing kind is for example described in FIGS. 34 to 36 of WO82/03538. In that case the support arm is formed as a rail, in which a roller guide moves, which is fastened to the top of the stand's mast. The post of an umbrella is pivotally connected to one end of the support arm, while the other end of the support arm is pivotally connected with the mast through a connecting member. For opening the umbrella the support arm must be swung upwardly at its end connected with the connecting member and at the same time must be pushed outwardly by means of the roller guide, until the connecting member is swung from a downward position to an upward position and engages the mast by means of a stop. The roller guide is then located near the end of the support arm connected with the connecting member. During the extending of the support arm the umbrella is simultaneously opened insofar as when the support arm is pushed out a cable pull is tensioned, the pull including a cable having one end fastened to the upper end of the mast and which cable is guided over a reversing roll into the interior of the umbrella post. The cable extends through the interior of the umbrella post to a slide of the umbrella which in the opened condition of the umbrella is free of the umbrella post. With the extension of the support arm the cable is tensioned and the slide is moved relative to the umbrella post and is finally stopped so that the umbrella is simultaneously arrested on the support arm. This large umbrella mechanism is not only complicated, but also requires a considerable effort, during the extension of the support arm and simultaneous opening of the umbrella, so that the size of the umbrella has to be limited. The cable pull does not assure a smooth guiding of the slide but instead tends to promote its tilting. Since the opened umbrella is fixed by means of the cable pull a swinging of the opened umbrella is not possible. Further the umbrella is not removable from the stand.

The object of the invention is to provide a large umbrella arrangment of the foregoing type wherein the stand includes an especially simple mechanism, which is easy and economical to manufacture and which because of simple operation makes possible the use of a support arm, of a large height and wide extension, so that an umbrella of large surface area can be connected to it. Further the umbrella should be light and of smooth operation during opening and closing. Finally the umbrella should be removable and selectively fixable in different positions.

In accordance with the invention the support arm for the umbrella is not connected to the upper end of the mast, but instead the connecting member, which is pivotally connected to the middle area of the support arm, can engage the mast with its mast-sided end and can do so at the lower end of the mast. By lifting the support arm along the length of the mast the extension of the support arm is not only simple but can be accomplished with little effort, and above all the opening of the umbrella is independent of the extending movement of the support arm. This further permits the support arm to be fixed in different positions.

The extension of the support arm can be further eased if the including a roll for engaging the mast.

It is possible to guide the end of the support arm which engages the mast by a rail, by a sleeve surrounding the mast or by a longitudinal slot in the mast, but preferably two forked arms receive the mast and serve not only to guide the support arm on the mast but also as a handle for extending and retracting the support arm. At the same time the forked arms can also serve to fix the support arm in different heighth positions.

A form of the large umbrella wherein the umbrella is detachably hung from a pin on the support arm is advantageous since then the folded umbrella can easily be removed from the stand if it is not needed. This form also allows the attachment of umbrellas of different size and/or shape to the stand. The protuding pin also makes possible a free hanging of the umbrella when the support arm is retracted.

The flexibility of the large umbrella can be increased by rotatably supporting the mast in an anchoring sleeve and releaseably locking it in different angular postions with a pawl mechanism, since then the support arm is rotatable about the axis of the mast and can be adjusted to and fixed in different angular positions. An especially convenient form of this rotatable arrangement of the mast is one wherein the mast has a removable sleeve insertable in the anchoring sleeve and carrying the pawl mechanism. For the form of the pawl mechanism different possibilities exist. For example, the upper edges of the anchoring sleeve could be provided along the length of its circumference with spaced recesses in which a hand operated lever could be inserted. However, an especially advantageous form is one which above all secures the mast against unwanted removal of the mast from the anchoring sleeve. The large umbrella also preferably has a cable pull made with pulleys while not only lowers the force required for opening the umbrella, so that one person can effortlessly open a very large umbrella, but which also has a symetrical arrangement of the pulleys which guarantees that the slide is guided on the umbrella post smoothly and without tilting. This is also especially of advantage if the slide in the closing of the umbrella does not remain on the umbrella post but instead moves free of the post.

The cable pull including pulleys can have one end of the cable fastened to the slide and have the cable guided in a pulley on the opposite side. At its upper end the cable pull can include only one pulley located in a recess of the umbrella post.

The umbrella arangement is preferably one having the advantage that the umbrella when not needed can be removed from the stand and protected from dirt and the influence of weather. Moreover, in accordance with the invention an automatic arresting and filing of the umbrella to the support arm of the stand upon the opening of the umbrella is guaranteed. In this case, an inclination adjustment of the umbrella is possible by means of the swingable support arm.

An embodiment of the large umbrella of the invention is described in more detail hereinafter in connection with the drawings which are;

FIG. 1—Side view of a large umbrella embodying the invention with its support arm retracted and the umbrella folded.

FIG. 2—Front view of the stand of FIG. 1.

FIG. 3—Fragmentary view mostly in vertical section showing the anchoring of the stand with a pawl mechanism.

Figure 4:
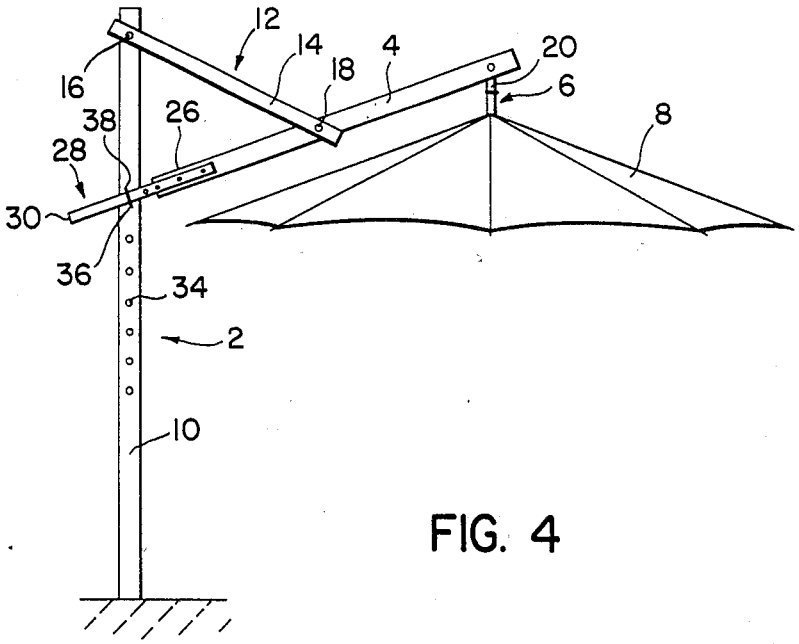

FIG. 4—Side view of the umbrella with the support arm fully extended and the umbrella opened.

Figure 5:
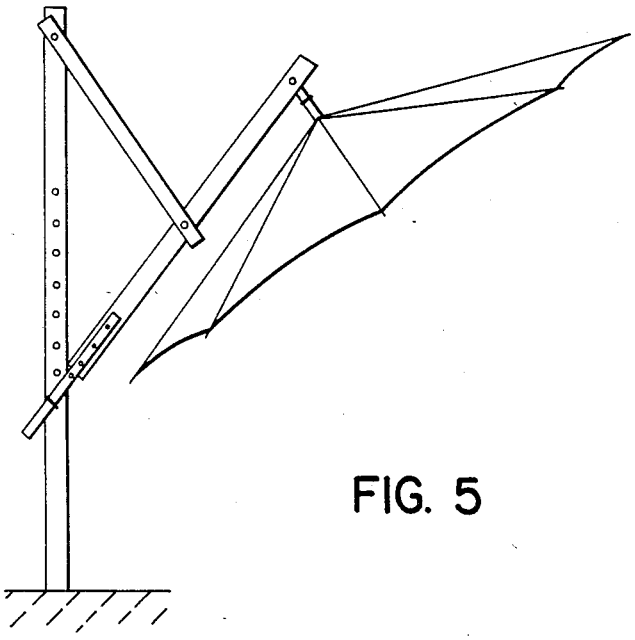

FIG. 5—Side view of the umbrella of FIG. 4 with the support arm partially extended and with an inclined arrangement of the umbrella.

Figure 6:
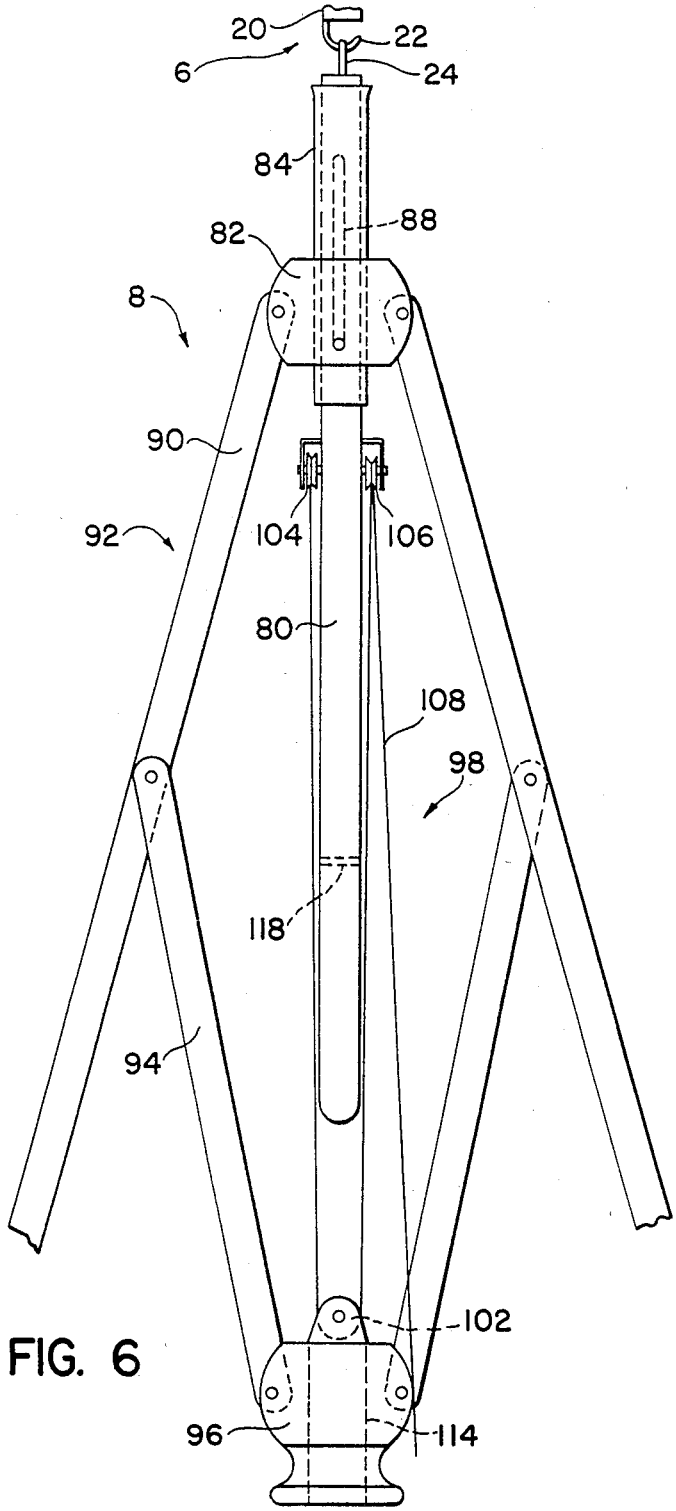

FIG. 6—Fragmentary side view showing the hung up frame of the umbrella in a nearly closed condition.

Figure 7:
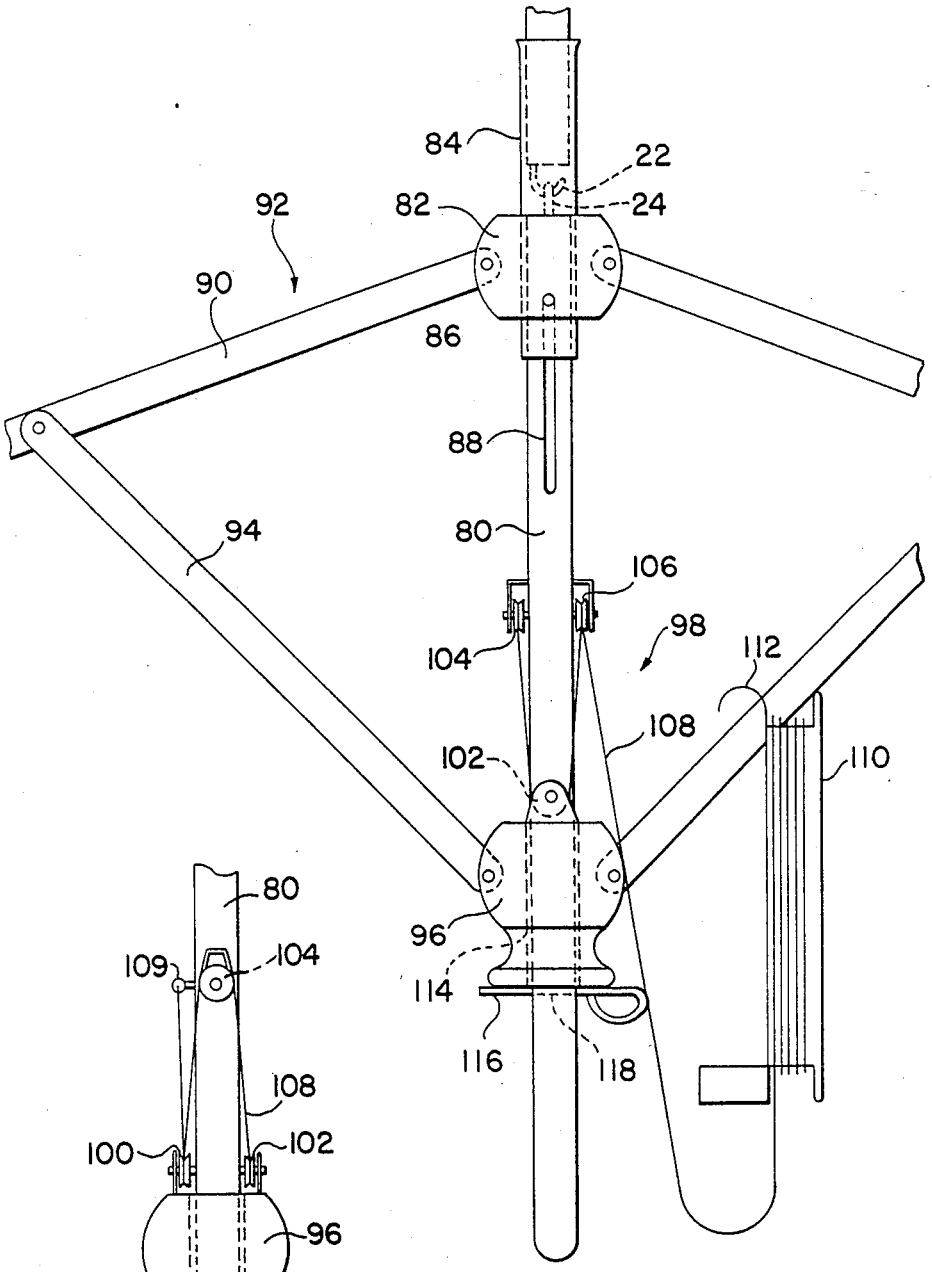

FIG. 7—View showing the umbrella frame of FIG. 6 in open condition.

Figure 8:
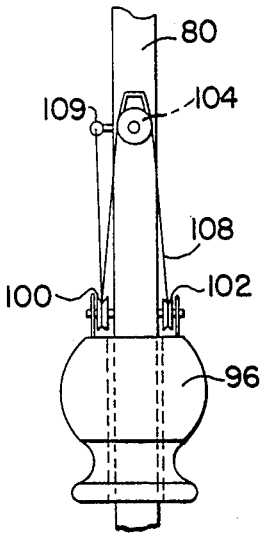

FIG. 8—View showing the slide and the cable pull as seen from a position rotated 90 degress from FIG. 7.

FIGS. 1 and 2 show a large umbrella with a stand 2, having an extendable and retractable support arm 4, from which an umbrella 8, is hung by a hanger means 6.

The stand 2 is made from a vertical mast 10, at the upper end of which a connecting member 12, consisting of two parallel struts 14, is pivotally connected by a bolt 16. The other end of the connecting member 12 is pivotally connected to the middle area of the support arm 4 by means of a further bolt 18. The support arm 4 has a pin 20 at its free end directed away from the mast and extending rigidly almost perpendicularly from the support arm 4. At its free end the pin has a hook 22 for hanging the umbrella 8 by means of an eye 24. The end 26 directed toward the mast 10 is provided with a fork 28 whose fork arms 30 are made of small struts connected by screws to the support arm 4. The fork arms 30 carry a roll 32 by means of which the end 26 of the support arm 4 rolls on the mast. Holes 34 are arranged in the mast 10 at different heights and serve to receive an arresting bolt 36 for holding the support arm at different heights relative to the mast.

The fork arms 30 therefore rest on the arresting bolt 36 which includes a safety hoop 38 which can receive one of the fork arms 30 and thereby restrain the support arm 4 against vertical upward movement.

As best seen in the FIG. 3, the mast 10 is provided with a sleeve 40 at its lower end which is inserted into an anchoring sleeve 42. The anchoring sleeve 42 can be secured in a base or in the floor 44 as shown in the illustrated case. The sleeve 40 of the mast 10 rests on a stop 46 in the anchoring sleeve 42. A detent device 48 serves to fix the mast in different angular positions as well as to secure the mast against unwanted removal from the anchoring sleeve 42. The detent apparatus 48 has a pawl level 50 pivotally connected to a lug 52 inside the sleeve 40. The pawl lever 50 includes an operating arm 56 extending outwardly through an opening 54 in the sleeve 40, as well as a downwardly extending pawl arm 58 biased toward the inner wall of the sleeve 40 by means of a spring 60. On the pawl arm 52 is a pawl pin 62 which extends into a further opening 64 in the sleeve 40 and cooperates with pawl recesses 66 spaced from one another along the circumference of the anchoring sleeve 42. Radially outwardly the pawl recesses 66 are covered by a protecting ring 68 to inhibit the entry of dirt into the pawl recesses. By means of the pawl lever 50 the mast can, therefore, be fixed in different angular positions. At the same time, the pawl pin 62 inhibits an unwanted removal of the mast out of the anchoring sleeve 42.

For further security, the pawl device 48 can be provided with a locking arrangement 70 formed by a lug 72 attached to the outside of the sleeve 40 and which is positioned parallel to the operating arm 56. Aligned holes 74, 76 are provided in the lug 72 and in the operating arm 56 for receiving a locking device, preferably a padlock 78.

FIG. 1 and FIGS. 6 to 8 show in detail the umbrella 8 hung from the support arm 4. The umbrella includes a short umbrella post 80 on whose upper end the eye 24 of the hanging means is fastened. A head 82 is slightably mounted on the umbrella post 80 by means of a sleeve 84. In connection with this the head 82 is fixed to the sleeve 84 by means of a bolt 86 which bolt passes through the umbrella post 80 and is guided in a vertically elongated slot 88. The sleeve 84 and the elongated slot 88 are so formed that the sleeve 84 can be shifted upwardly to receive the pin 20 of the hanging means 6 of the support arm 4 as shown in FIG. 7 and explained below in further detail. Ribs 90 of the umbrella roof structure are pivotally connected to the head 82. Further support ribs 94 are pivotally connected to the ribs 90 and are also pivotally connected with a slide 96, which slide in the closed state of the umbrella is located below the umbrella post 80 as shown in FIG. 6. A cable pull mechanism serves to operate the umbrella 8. It is constructed as a pulley and cable pull and includes two pulleys 100, 102 located on opposite sides of the slide 82. Two further pulleys 104, 106 are displaced respectively by 90 degrees from the pulleys 100, 102 and arranged on opposite sides of the umbrella post 80 below the head 82. One end of the cable is fastened to an eye 109 attached to the umbrella post 80.

The cable 108 guided by the different pulleys hangs freely downwardly and is wound on to a winder 110. This winder 110 includes a hook 112 by means of which it may be hung from the umbrella frame.

To open the umbrella it is necessary to move the support arm 4 from the retracted position to FIG. 1 to the extended position of FIG. 4 in which the pin 20 extends vertically downwardly, as also shown in FIGS. 6 and 7. To do this, the cable 108, which conveniently extends slightly out of the umbrella 8, is grasped. By pulling on the cable 108 the slide 96 is hoisted by the pulley and cable mechanism until it runs onto the umbrella post 80 with its vertical bore 114. Pulling of the cable 108 is then continued until the umbrella roof is raised, that means the head 82 pushes the sleeve 84 over the hanging means 6 and onto the pin 20 until the bolt 86 reaches the upper end of the longitudinal slot 88. The opened umbrella is fixed in this position by inserting a securing pin 116 below the slide 96 into a transverse hole 118 in the umbrella stock 80. The free length of the cable can then be wound onto the winder 110 and the winder hung onto the umbrella frame. Thus, since the sleeve 84 receiving the hanging means 6 is pushed onto the pin 20, the umbrella is secured against unwanted removal from the support arm 4, but moreover, the umbrella is secured in this position so that it can be swung by adjustment of the support arm, as shown in FIG. 5. The closing of the umbrella takes place in a sequence of steps reversed from the sequence of steps used for its opening.

Further implementations and modifications of the illustrated large umbrella are possible.

For example, the sleeve of the head serving as the arresting member can be replaced by pins connected to the head and extending upwardly, which pins during opening of the umbrella are received in corresponding bores in the support arm. Thus by these means, a fixing of the umbrella to the support arm is also possible with the hanging means at the same time being secured against loosening. Also an arresting rod connected with the slide and which runs through the axis of the umbrella post and upon opening of the umbrella is received in a recess in the support arm can be used for the same purpose.

For the construction of the pulley and cable mechanism a number of different implementations are available. For example, the end of the cable can be fastened to the slide and the cable can be guided over a pulley on the opposite side of the slide. Also, instead of the two pulleys on the umbrella post, one pulley can be arranged in a recess of the umbrella post on its axis. Also, pulley and cable mechanisms with more than the pulleys shown in the figures are possible.

The stand with support arm shown by the figures, the illustrated pulley and cable actuation with symetrically arranged pulleys, as well as the arresting of the hanging umbrella, can also each be used with large umbrellas of different construction.

REFERENCE NUMBER LIST

2: stand
4: support arm
6: hanging means
8: umbrella
10: mast
12: connecting member
14: strut
16: bolt in 10
18: bolt in 4
20: pin
22: hook
24: eye
26: end of 4 on 10
28: fork
30: fork arm
32: roll
34: bore
36: arresting bolt
38: securing hoop
40: sleeve on 10
42: anchoring sleeve
44: floor
46: stop
48: detent device
50: pawl lever
52: lug
54: opening
56: actuating arm
58: pawl arm
60: spring
62: pawl pin
64: opening
66: pawl recess
68: protective ring
70: arresting device
72: lug
74: through going bolt of 72
76: through going bolt of 56
78: pad lock
80: umbrella post
82: head
84: sleeve
86: bolt
88: elongated slot
90: roof rib
92: umbrella roof
94: support rib
96: slide
98: pulley and cable mechanism
100: pulley of 96
102: pulley of 96
104: pulley of 80
106: pulley of 80
108: cable
109: eye for 108 on 80
110: winder
112: hook
114: bore of 96
116: securing pin
118: cross bore

We claim:

1. A large umbrella arrangement, said arrangement comprising a stand having a generally vertical mast, a support arm having first and second ends, means connecting said support arm to said mast for movement relative to said mast between a retracted position at which said first end is located close to said mast and an extended position at which said first end is located remote from said mast, said connecting means including an elongated connecting member pivotally connected at one of its ends to the upper end area of said mast and pivotally connected at the other of its ends to the middle area of said support arm, said second end of said support arm engaging said mast at an adjustable heighth which adjustable heighth determines the spacing of said first end of said support arm from said mast and the inclination of said support arm from said mast, an umbrella separate in its construction from said support arm and mast and connecting member, said umbrella including opening and closing means, and means connecting said umbrella to said free end of said support arm and cooperating with said opening and closing means of said umbrella whereby when said umbrella is closed said umbrella is suspended from said free end of said support arm and may be detached from said support arm by bodily movement of said umbrella relative to said support arm and when said umbrella is open said umbrella is rigidly fixed to said support arm so that the angle of said umbrella relative to a vertical line may be varied by varying the heighth of said second end of said support arm relative to said mast.

2. A large umbrella arrangement according to claim 1 further characterized in that said second end of said support arm carries a roll which engages the mast.

3. A large umbrella arrangement according to claim 1 further characterized in that said second end of said support arm is provided with a guide means for receiving the mast, said guide means being in the form of a fork overlapping the mast on both sides, and an arresting bolt fastenable to the mast at different heighth positions and engageable with said fork to limit downward movement of said second end of said support arm relative to said mast.

4. A large umbrella arrangement according to claim 1 further characterized in that said umbrella includes an umbrella post having an upper end, and in that said means for connecting said umbrella to said free end of said support arm includes a pin on the free end of said support arm which pin extends nearly perpendicularly from the side of the support arm facing away from the mast and is rigidly connected to the support arm, a hook and eye connector between said pin and said upper end of said umbrella post, and arresting means on said umbrella movable by said opening and closing means for engaging said pin to hold said umbrella post aligned with said pin, said arresting means being engageable with said pin to hold said post aligned with said pin when said opening and closing means is in its open condition and said arresting means being out of engagement with said pin to allow said umbrella to hang freely from said pin through said hook and eye connection when said opening and closing means is in its closed condition.

5. A large umbrella arrangement, said arrangement comprising a stand having a generally vertical mast, a support arm having first and second ends, means connecting said support arm to said mast for movement relative to said mast between a retracted position at which said first end is located close to said mast and an extended position at which said first end is located remote from said mast, said connecting means including an elongated connecting member pivotally connected at one of its ends to the upper end area of said mast and pivotally connected at the other of its ends to the middle area of said support arm said second end of said support arm engaging said mast at an adjustable height which adjustable height determines the spacing of said first end of said support arm from said mast, an umbrella separate in its construction from said support arm and mast and connecting member detachably carried by said first end of said support arm, an anchoring sleeve, said mast at its lower end being rotatably received in said anchoring sleeve, and a pawl mechanism located between said mast and said anchoring sleeve to selectively fix said mast in different angular positions about its longitudinal vertical axis relative to said anchoring sleeve, said pawl mechanism including a pawl lever located and pivotally supported by said mast which pawl lever has an outwardly extending actuating arm and a pawl arm extending downwardly into said anchoring sleeve and biased outwardly, said anchoring sleeve having a plurality of pawl recesses spaced along its circumference, and a pawl pin carried by said pawl arm and insertable in a selected one of said pawl recesses to fix said mast against both angular and longitudinal movement relative to said anchoring sleeve.

6. A large umbrella arrangement according to claim 5 further characterized by a lock mechanism associated with said pawl mechanism, said lock mechanism including a lug on said mast extending parallel to said actuating arm when said pawl lever is in such position that said pawl pin is engaged with one of said pawl recesses, said lug and said actuating arm having aligned holes for receiving a lock.

7. A large umbrella arrangement, said arrangement comprising an umbrella having an opening and closing mechanism whereby it may be shifted between open and closed conditions, a stand with a support arm, and a connecting means for holding said umbrella in a fixed position on and relative to said support arm when in said open condition and for allowing said umbrella to hang in a freely moveable manner from said support when in said closed condition, said connecting means including a hanging member fixed to said support arm, a means for moveably hanging said umbrella from said hanging member, and an arresting member connected with said opening and closing mechanism which arresting member in said open condition of said umbrella is engageable with said hanging member to hold said umbrella in a given position relative to said support arm.

8. A large umbrella arrangement according to claim 7 further characterized in that said opening and closing mechanism includes an umbrella post, a head slideable along the length of said umbrella post as said mechanism is operated to shift said umbrella between said open and closed conditions and carrying said arresting member, said arresting member in the closed condition of said umbrella being positioned free of said hanging member and in the open condition of said umbrella receiving said hanging member to prevent movement between said umbrella and said hanging member.

9. A large umbrella arrangement according to claim 8 further characterized in that said arresting member is formed as a sleeve connected with said head by means of a transverse bolt, and said hanging member is a pin fixed to said support arm which pin is received by said sleeve in the open condition of said umbrella.

* * * * *